US007626345B2

(12) United States Patent
Young

(10) Patent No.: US 7,626,345 B2
(45) Date of Patent: Dec. 1, 2009

(54) LED ASSEMBLY, AND A PROCESS FOR MANUFACTURING THE LED ASSEMBLY

(75) Inventor: Garrett Young, Freehold, NJ (US)

(73) Assignee: Dialight Corporation, Farmingdale, NJ (US)

( * ) Notice: Subject to any disclaimer, the term of this patent is extended or adjusted under 35 U.S.C. 154(b) by 94 days.

(21) Appl. No.: 11/063,828

(22) Filed: Feb. 23, 2005

(65) Prior Publication Data

US 2006/0186819 A1 Aug. 24, 2006

(51) Int. Cl.
*H05B 37/02* (2006.01)

(52) U.S. Cl. ..... 315/307; 315/291; 315/323

(58) Field of Classification Search ..... 315/323, 315/291, 307, 157, 158; 445/23
See application file for complete search history.

(56) References Cited

U.S. PATENT DOCUMENTS 6,411,046 B1 6/2002 Muthu ..... 315/309
2002/0047624 A1 4/2002 Stam et al. ..... 315/307
2002/0097000 A1 7/2002 Muthu et al. ..... 315/169.3
2003/0011832 A1* 1/2003 Chang ..... 358/518

* cited by examiner

*Primary Examiner*—Trinh V Dinh
*Assistant Examiner*—Dieu Hien T Duong
(74) *Attorney, Agent, or Firm*—Oblon, Spivak, McClelland, Maier & Neustadt, L.L.P.

(57) ABSTRACT

A manufacturing process for storing measured light output internal to an individual LED assembly, and an LED assembly realized by the process. The process utilizes a manufacturing test system to hold an LED light assembly a controlled distance and angle from the spectral output measurement tool. Spectral coordinates, forward voltage, and environmental measurements for the as manufactured assembly are measured for each base color LED. The measurements are recorded to a storage device internal to the LED assembly. Those stored measurements can then be utilized in usage of the LED assembly to provide accurate and precise control of the light output by the LED assembly.

7 Claims, 9 Drawing Sheets

POSSIBLE COLOR OPTIONS
n=1, COLOR=RED
n=2, COLOR=GREEN
n=3, COLOR=BLUE
n=4, COLOR=AMBER

POSSIBLE ENVIRONMENTS
E=1, TEMP=AMB
E=2, TEMP=COLD
E=3, TEMP=HOT

LED ASSEMBLY, AND A PROCESS FOR MANUFACTURING THE LED ASSEMBLY

BACKGROUND OF THE INVENTION

1. Field of the Invention

The present invention is directed to an LED (light emitting diode) assembly and to a method of manufacturing the LED assembly, and which is particularly adapted to address issues of color differences between different LEDs within the LED assembly.

2. Description of the Background Art

Traditional light sources are most commonly either incandescent or gas discharge. Each has advantages and disadvantages. Although inexpensive to manufacture, the traditional incandescent bulb suffers from two disadvantages. First, most of the input energy of traditional lighting is wasted as heat or infrared (non-visible) light; only a small amount of the input energy is transferred to visible light. Second, the lifetime of the incandescent bulb is limited and when failure occurs it is catastrophic. Traditional fluorescent bulbs have a longer life, but have significant performance variations across a range of temperatures. At some colder temperatures fluorescent bulbs do not function at all. Halogen light sources are a slight improvement in efficiency and lifetime over incandescent light sources for a marginal increase in cost.

Traditional sources of lighting can produce exact colors by filtering. The filtering process takes white lighting and removes all the light except the required light of the specified color and therefore further reduces the efficiency of the light source. Traditional lighting also is broadcast in all directions from the source, which may not be advantageous when the goal is to illuminate a small object. Lastly, traditional lighting has a non-linear relationship between brightness and input current. This non-linearity makes it difficult to dim the light source easily.

LEDs overcome many of the disadvantages of traditional lighting because of their significantly longer lifetime, higher efficiency, and ability to direct the light. The Mean Time Between Failures (MTBF) of typical incandescent light sources is in the order of 10,000 hours. The MTBF of LEDs is on the order of 1-10 million hours. Typically only 5% of the input energy is transferred to visible light for an incandescent light. Similarly, for LEDs about 15% of the input energy is transferred to visible light. The ratio of lumens of light output divided by the watts of input energy is another way to look at the efficiency. Traditional lighting has about 17 lumens/watt, whereas LED based (white) light sources are about 35 lumens/watt. The efficiency improvement equates to lower power consumption or higher light output for similar applied power. Generally, an individual LED produces a low level of light output that is insufficient for usage as a light source. Combining a number of LEDs into an assembly or array allows the array to be a reliable and cost effective replacement for traditional light sources.

When designed and fabricated, an array of LEDs in an assembly can be electrically interconnected in parallel, in series, or any combination thereof. Additionally, the LEDs in the assembly can be a single base color or many different colors. By combining several different colors into one assembly, a wide range of specified colors can be displayed by the light engine. These LED light engine assemblies are gaining widespread usage because of their ability to reduce electrical usage, improve maintenance costs, and allow dynamic, custom color projection.

LED assemblies are also rapidly replacing light bulbs in the Human Safety marketplace. Human Safety applications might include traffic lights, safety beacons on towers, warning lights at rail crossings, emergency egress lighting, aircraft runway lighting, and many more applications. In these applications LED light sources are gaining popularity for two reasons: (1) the increased reliability of LEDs, and (2) the reduced costs and difficulty of the repair and maintenance functions.

At the present time LED based light engines are in operation for Human Safety Applications in hundreds of thousands locations throughout the world.

LED lighting is also beneficial in architectural and theatrical applications. The benefit lies not only with the ability to produce an exact and repeatable light for changing moods and emotions but also with the ability to produce these colors dynamically and across a large number of light sources. This practice has been available in theatrical lighting for many years in various forms with tremendous improvement in digital color on demand in the relatively recent past. For architecture, the practical use of color remains limited largely due to the cumbersome use of theatrical grade fixtures in architectural applications. The promise of LED lighting is the ability to accomplish dynamic color in a more useful form factor and in real time for both theater and architectural applications.

A typical LED assembly includes a number of LEDs installed into a system, and typically all of the LEDs are a single base color. The technology is progressing and new requirements are emerging for the production of a broad spectrum of colors from combinations of two, three, four or more base colors of LEDs. Many assemblies under development include several Red LEDs, several Green LEDs, and several Blue LEDs. Several LEDs are needed of each color, because a single LED does not provide sufficient light for a light engine. Different LED colors are needed so that the different colors can be combined to make a broad spectrum of custom lighting effects.

A generalized LED assembly 10 is shown in FIG. 1. The LED assembly 10 includes an LED light source 11, which in turn includes individual LEDs 12 of different colors represented by the designators—R (red), G (green), and B (blue). The LED assembly 11 includes the LEDs 12 and a support and associated circuitry for driving the LEDs. The associated circuit and support includes an electronic carrier or printed circuit board (not shown) to mechanically hold the LEDs 12 and to provide electrical input to the LEDs 12, a power supply 13 to convert input power into a usable form for the LEDs 12, control electronics 14 to turn the LEDs 12 on and off appropriately, perform algorithms on the electronic signal and communicate with other equipment in a larger lighting system, and a lens or diffuser (not shown) to modify the light appearance from several small point sources to a look that is both pleasing to a human and functional for the product.

LED assemblies do, however, have the following disadvantages recognized by the present inventor. Variations within manufacturing of the optical and electrical output properties are sizeable. Targeted output colors are difficult to achieve because of the manufacturing variations of the LEDs. The optical output varies over the product lifetime; for instance, the output intensity degrades with time. The dominant wavelength is highly dependent on temperature. And, intensity drops with temperature increases.

Further, for LEDs different semiconductor compounds are used to produce different colors. Each compound will change at a different rate with respect to temperature and long term degradation. This has made the color stability of an array of RGB (Red, Green, Blue) LEDs difficult.

The fact that LED light output varies proportionately with input current is generally an advantage of LEDs; it becomes a disadvantage when an LED assembly is used as a direct replacement for an incandescent bulb. This is because the control system compensates for the non-linearity of the incandescent bulb and produces nonsensical output with the replacement LED assembly.

Lighting control systems or consoles address a limited number of light outputs with a limited number of possible color specifications and may require cumbersome hardware to address large lighting systems.

Temperature variations of the LEDs can occur for two reasons. One source is the outside environment. LED light sources can be installed in controlled temperature environments, examples of which would be home or office buildings. Alternatively, they can be installed in uncontrolled temperature environments where temperature variations are in the range of human habitability and beyond. The second source of temperature variability is the efficacy of the thermal dissipation within the specific system. Optical output properties are related to the die temperature. The die temperature is related to the outside environment, but also the thermal resistance of the entire path from the die to the outside world.

The dominant wavelength (represented by $\lambda_d$) and the optical intensity exhibit quantifiable changes with these temperature changes. With sufficient temperature variations the change in the dominant wavelength can be discernible by the human eye. At some wavelengths (near the color amber) changes of 2-3 nanometers (nm) are discernible to the human eye; at other wavelengths (near the color red) changes of 20-25 nm are required before the human eye can differentiate a color shift. The intensity change with temperature is discernible as well. Temperature increases of 60° C. can reduce output by approximately 50%.

The current state of the art partially addresses the issues. The manufacturing variation of the LED optical output is resolved by sorting or binning the LEDs into groupings of similar optical properties. The optical response of an incandescent light has been mimicked in the control software and hardware for the array, see for example U.S. Pat. No. 6,683,419. The initial power output of the LED can also be overdriven, which results in acceptable power outputs over a longer period of time.

The current state of the art, however, does not resolve the following issues. Exact color generation of a specified color is still not achievable. Binning of the LEDs is not always sufficient to produce an accurate color across all environments because of the wide variations in the LED optical properties within a bin. Temperature variations effects on LED output wavelength and intensity are not compensated for.

SUMMARY OF THE INVENTION

Accordingly, one object of the present invention is to provide a novel LED assembly and novel method of manufacturing the LED assembly that can efficiently and consistently provide a desired color output of the LED assembly.

A more specific object of the present invention is to provide a novel LED assembly and novel method of manufacturing the LED assembly that can compensate for color variations of individual LEDs within the LED assembly.

The present invention achieves the above and other objects by manufacturing a LED assembly by driving all LEDs of a first color and measuring information of an optical output of the driven LEDs. That information may include color information and forward voltage of the LEDs of the first color. An environmental condition is also then measured. Further, in the LED assembly the measured environmental condition and measured optical information of the optical output of the LEDs is stored. The above operation is then repeated for each color of LEDs in the LED assembly.

By performing the above process, an LED assembly is realized that includes plural sets of LEDs of different colors. Further, control electronics within the LED assembly control driving of the plurality of LEDs by utilizing the stored measured optical information of each of the LEDs at at least the one measured environmental condition. The LED assembly also utilizes a compensation algorithm to control driving of the plurality of LEDs based on the stored information of the LEDs and a sensed current environmental condition, and utilizes a color mixing algorithm to control driving of the plurality of the LEDs based on the stored measured information of the LEDs and an input desired color output.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
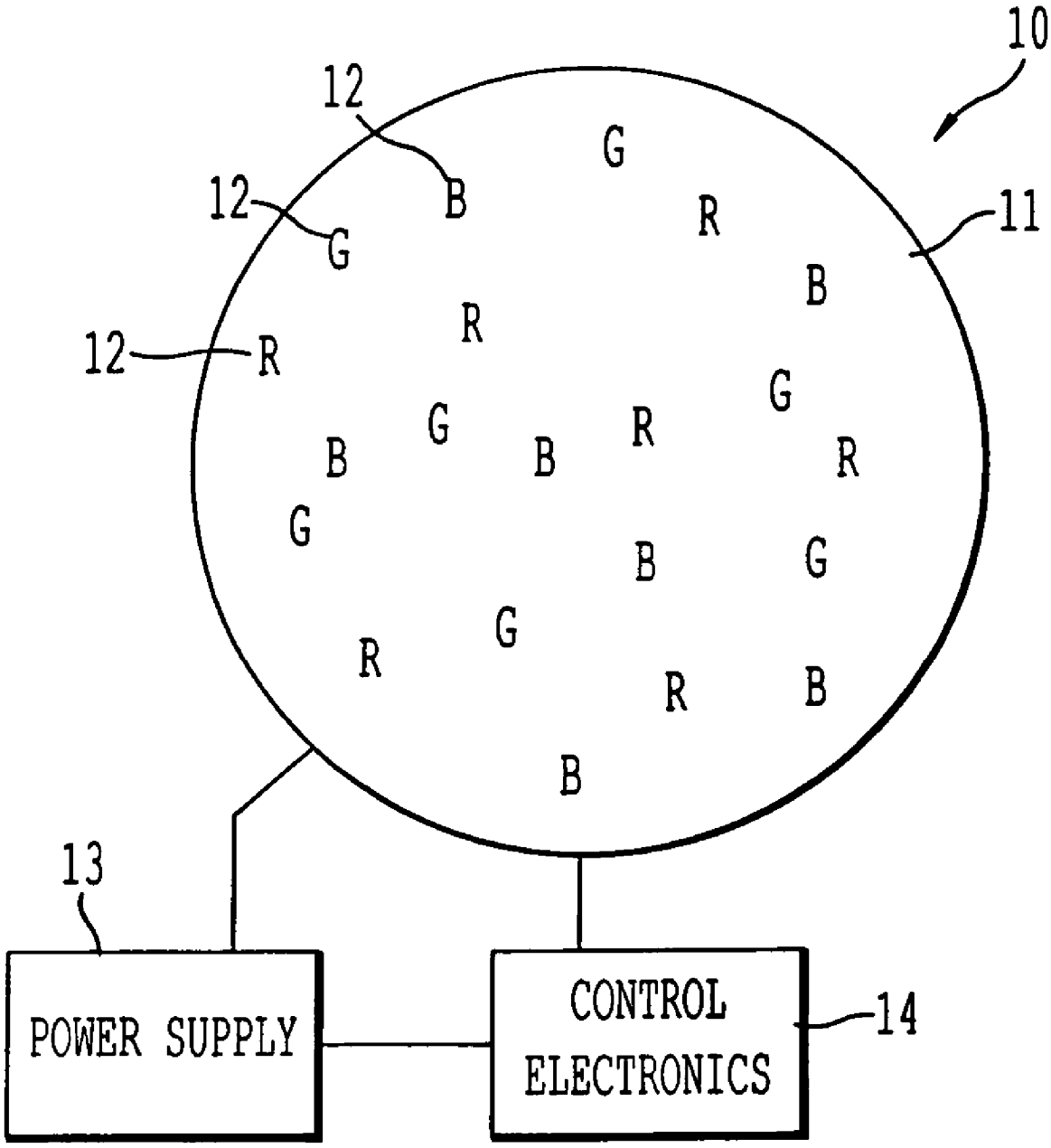
FIG. 1 BACKGROUND ART
FIG. 1 shows a generalized background LED light assembly.

Referring now to the drawings, wherein like reference numerals designate identical or corresponding parts throughout the several views, features of the present invention are detailed.

Figure 2:
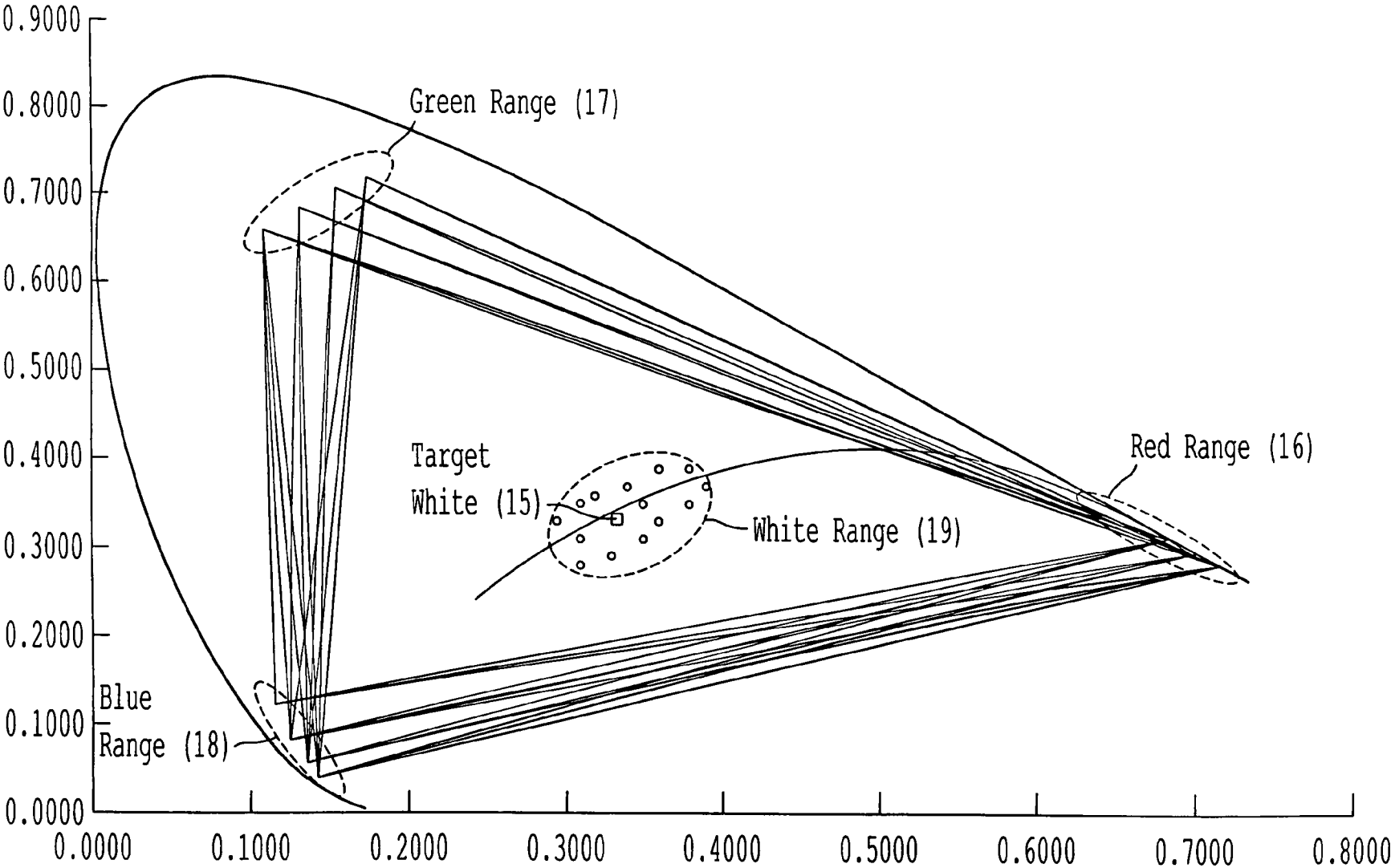
FIG. 2 explains LED color specifications on a CIE chromaticity chart.

Color output can be specified using the CIE Color Coordinate System. Other appropriate schemes for specifying color can also be utilized. CIE is an abbreviation for "The Commission Internationale de l'Eclairage" and is an international standards development group that first described ways of quantifying color in a standard written in 1931. The CIE Color Coordinate System is an accepted standard for the measurement of a spectral distribution and defines a color using an x coordinate, a y coordinate, and a Y'coordinate. The CIE Color Coordinate System is a device independent way of describing color and is therefore also described as a universal coordinate system for defining colors, and is shown graphically in FIG. 2. FIG. 2 shows the CIE Chromaticity Chart with the CIE Color tongue. The CIE Color tonque shows the x, y, and Y' coordinates for saturated colors. The x coordinate and the y coordinates are normalized and are represented on a scale of 0 to 1. Both x and y coordinates are unitless and specify the color. Y' specifies the intensity and is normalized to a unitless number as well.

Typical Red, Green, and Blue LED color outputs are shown in FIG. 2. By interconnecting coordinates representing Red, Green, and Blue, a triangle is created. The CIE coordinates within this triangle represent the range of available colors for display. Points outside of the triangle can not be displayed with the given light sources. The center point of the triangle is the CIE coordinate of the max combination of the Red, Green, and Blue light sources and is theoretically White.

The manufacturing process for the production of LEDs is inconsistent and produces LEDs with a large variability in their output. This variability is shown for Red, Green, and Blue graphically by the span of the ovals (16), (17), and (18) respectively. FIG. 2 also identifies a Target White (15) and shows an additional oval (19) that represents the range of displayed White for combinations of the three color light sources of Red (16), Green (17), and Blue (18).

FIG. 2 shows the white range (19) of the displayed color without compensation for the many sources of variability of the LEDs. This variability of the individual LEDs includes degradation in output intensity over the LED lifetime, changes in dominant wavelength with temperature, changes in output intensity with temperature, variability within the manufacturing process, and more.

Figure 3A:
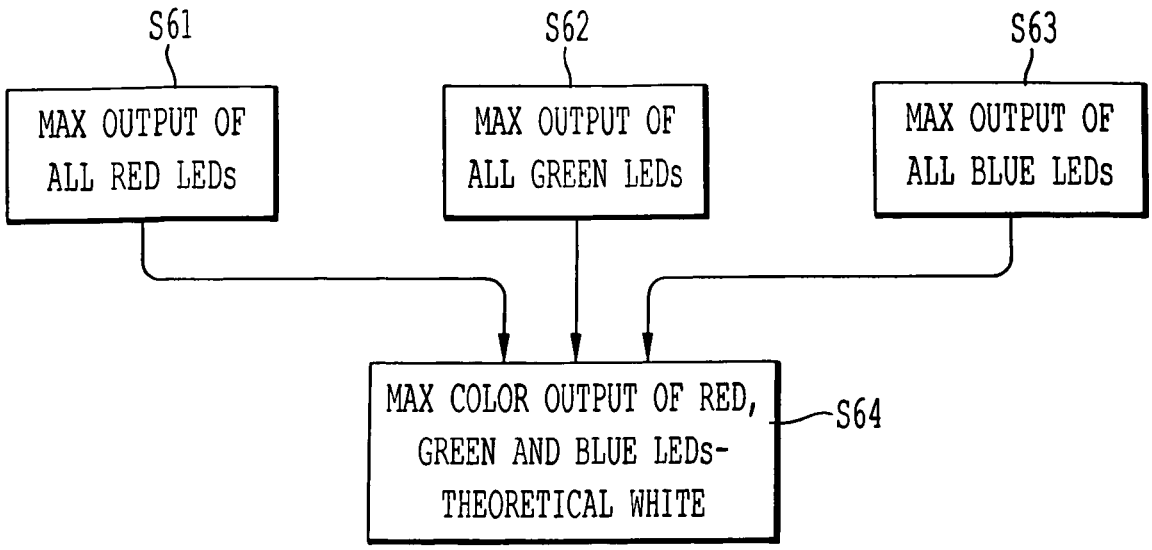
FIGS. 3*a* and 3*b* show processes for uncompensated optical output of an LED assembly.

FIG. 3*a* is a simplistic or uncompensated process for producing white light from the output of Red, Green, and Blue LEDs. The process shown in FIG. 3 includes three simultaneous steps S61, S62, and S63 in which respectively a maximum output of all of the red LEDs, a maximum output of all the green LEDs, and a maximum output of all the blue LEDs are generated. By performing those steps driving each of the Red, Green, and Blue LEDs to their maximum output, a maximum color output of the Red, Green, and Blue LEDs is generated in step S64 giving a theoretical white light output. That is, maximally mixing the Red, Green, and Blue, LEDs should provide a white light. However, because of differences between color outputs of individual of the LEDs, such a system has a drawback in that the variations in the color outputs of the Red, Green, and Blue LEDs may not result in a pure white output. The variability of the output from the process of FIG. 3*a* is shown on the CIE Chromaticity Chart in FIG. 2 as (19) and may be sufficient to cause a measurable difference of the white light from a theoretical white. The difference may be discernible by the human eye. The additive process of FIG. 3*a* does not compensate for LED variability and may produce an inexact white. In addition to being inaccurate the result is inconsistent.

Figure 3B:
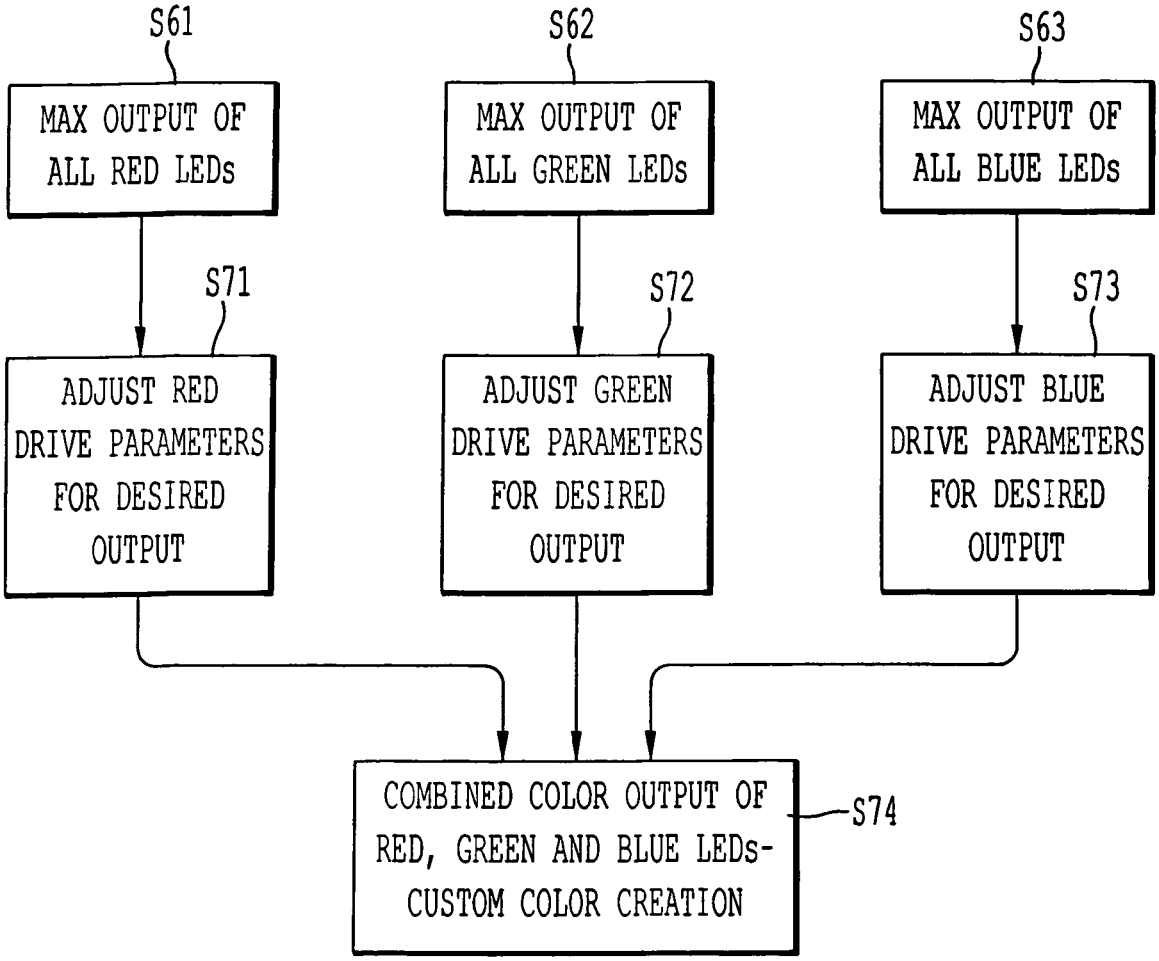

FIG. 3*b* is a similar simplistic or uncompensated process to produce a custom color. In the process of FIG. 3*b*, initially each of the Red, Green, and Blue LEDs are each driven at their maximum output in steps S61, S62, S63, as in FIG. 3*a*. Then, a scaling is introduced to each of those outputs to produce a desired color. More specifically, step S71 adjusts Red LEDs drive parameters to obtain a desired Red light output, step S72 adjusts Green LEDs drive parameters to obtain a desired Green light output, and step S73 adjusts Blue LEDs drive parameters to achieve a desired Blue light output. Each of steps S71, S72, and S73 can achieve the desired scaling by modifying drive parameters such as duty cycle and drive current for each of the respective Red, Green, and Blue LED outputs. The combined output is, ideally, the desired custom color. Unfortunately this simplistic process may also yield unacceptable results. LED variability at each of the three input stimuli induced by a number of factors may yield an inaccurate and inconsistent representation of the target color.

Single color LED light engine assemblies have been in production for a number of years. The variability associated with the fabrication of single color LEDs and the precise requirements of the Human Safety marketplace, where they have chiefly been implemented, have challenged the LED assembler to produce an accurate output color for the entire system. The LED manufacturers have assisted the assemblers by pre-sorting or binning the LEDs into smaller ranges of variability prior to shipment. The smaller range of LED input stimuli has assisted the assembler in producing a target output color. Acceptable color rendering is still a demanding task because even the bins have a sizeable range of the performance variations.

The binning operation can become complex quite quickly. An assembly with only Amber LEDs shall be used as an example. The Amber LED arrives from the manufacturer sorted by five flux values which may be identified with the labels V, W, X, Y, and Z. The variation across each flux bin can be ±15% or more. The dominant wave length may vary ±2.5 nm and may be broken into five bins labeled 1, 2, 3, 4, and 5. Five additional bins are created based on Forward Voltage ($V_f$) values varying ±5% and labeled a, b, c, d, and e. The result of all this sorting is that the Amber LEDs arrive at the assembler sorted into 5*5*5 or 125 possible bin locations. A bin of Amber LEDs might be labeled as a W4e; W specifying its flux range, 4 specifying its dominant wavelength, and an e specifying its Forward Voltage.

The LED assemblies can be fabricated using recipes of LEDs from the different bins of Amber LEDs. Each recipe contains the acceptable bin code or bin codes for each LED location within the electronic carrier of the LED light engine assembly design. Acceptable recipes are engineered prior to fabrication to an output that is acceptable to the customer's required optical parameters. The acceptable recipes are determined using optical performance calculations and verified experimentally. With a large number of LEDs in the assembly and a large variation of the optical output within a bin, it becomes increasingly difficult to assure the optical output of the entire assembly is acceptable to the customer—even with a recipe.

There are generally a number of acceptable recipes for each product. Having a number of recipes allows the assembler the flexibility to build the assembly in several different ways to account for inventory variations of the different bins of LEDs. However, even with a number of acceptable recipes for each product design, inventory management of the bin contents in high volume production can be a challenge to the assembler. Conversely, it is sometimes a challenge to find an acceptable recipe of LED bins with an existing inventory of bin quantities.

The above example used a simple LED assembly with only one color LED. The complexity of the recipes increases multifold when a design involves several different color LEDs and the recipes involve pulling LEDs from bins of several different base colors. In reality, multiple color LED light engine assemblies have been marginally successful. The accuracy issue of a single color becomes multiplied into a larger problem; the end result may be unacceptable color rendering. In summary, binning has allowed volume production of acceptable single color LED light engine assemblies. However, binning for single color assemblies lacks flexibility for manufacturing and can produce light output outside the range of acceptability. Binning becomes difficult or impossible to manage in multiple color LED assemblies and the resulting product is generally unacceptable.

The process of the present invention addresses such drawbacks by measuring a baseline optical performance of each unique, individual LED light engine assembly at the time of manufacture to quantify the exact color and intensity of the output, as discussed in further detail below. The quantified values of the baseline measurement of the color are then stored within the LED assembly and available to the system for compensation to the driving input parameters to produce an accurate and repeatable output throughout the life of the system.

Figure 4:
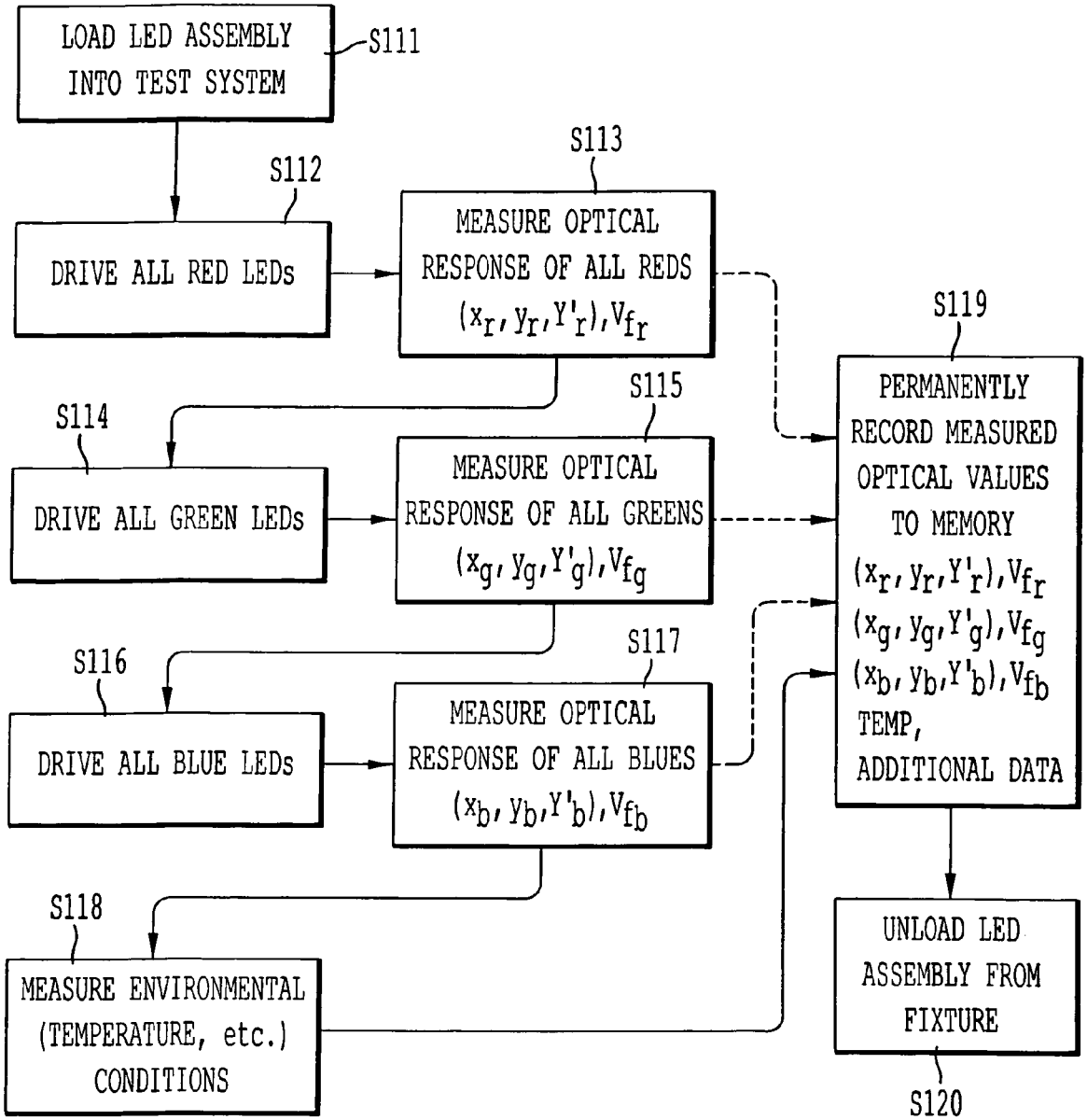
FIG. 4 shows a process flow of operations conducted in a method of manufacturing an LED assembly according to the present invention.
Figure 5:
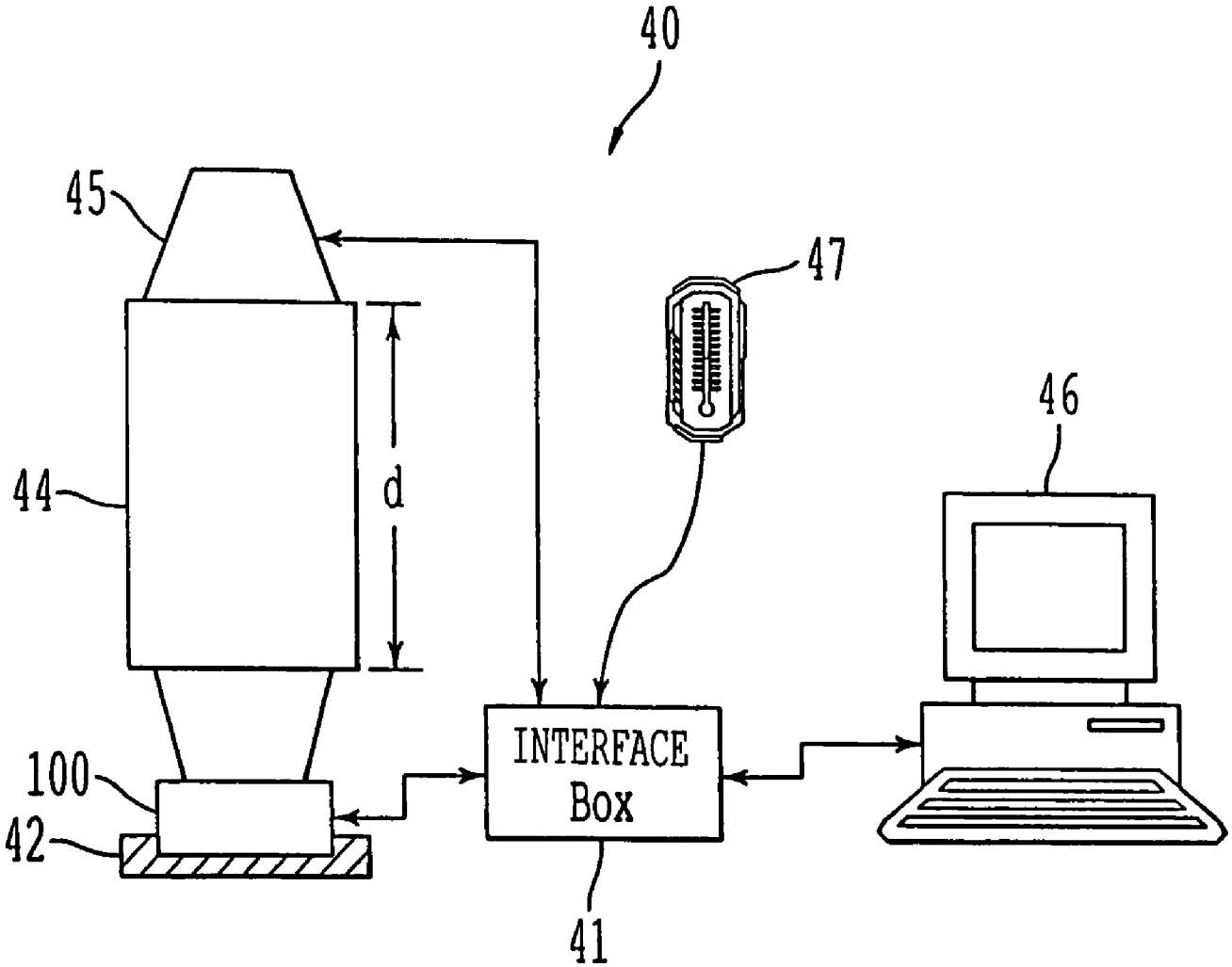
FIG. 5 shows a simplified pictorial of a manufacturing fixture utilized in a method of manufacturing the LED of the present invention.

The present inventor developed a process shown in FIG. 4 that uses a test system 40 of FIG. 5. The process of FIG. 4 is performed after assembly of all LEDs and other control electronics but prior to shipment at the manufacturing facility.

In the process each individual LED assembly 100 is loaded onto a manufacturing test system 40 (see FIG. 5) at the beginning of the process, step S11 (see FIG. 4). The test system 40 includes a holder 42 for constraining the LED assembly 100 a fixed distance, d, from an optical measurement instrument 45. A shield 44 directs the light, and prevents stray light entry to the optical measurement instrument 45.

The test system 40 also includes control electronics as well. The control electronics are divided between a customized interface box 41 and the internal circuitry of a customized computer or workstation 46. The test system 40 control electronics include a measurement device for measuring the current temperature, a control device for controlling the LEDs, a measurement device for measuring voltage, and a device for writing data to a memory of the LED assembly, which can be accommodated in the interface box 41, the workstation 46, or on control electronics internal to the LED assembly 100.

After loading the LED assembly 100 into the test system 40, the process directs the control circuitry to drive all of the Red LEDs and only the Red LEDs, step S112. The control circuitry for this process can either be internal to the LED assembly 100 or internal to the test system controller workstation 46. The allRed output is then measured in step S113 with the optical measurement device 45, which for example may include a spectrophotometer. The CIE coordinates for the allRed output and the forward voltage at the allRed are measured in step S113. Step S114 is similar to step S112 except that only all the Green LEDs are driven by the control circuitry. The CIE coordinates of the output for allGreen and the forward voltage for allGreen are measured in step S115 by the optical measurement device 45. Process step S116 is also similar to step S112 except that only all the Blue LEDs are driven by the control circuitry. Step S117 measures the allBlue optical output and the allBlue forward voltage. The steps S112, S114, and S116 may be easiest to implement if all the Red, Green, and Blue LEDs are driven at 100% maximum input condition. However, because LED flux output is mathematically related to its input current, the processes could be implemented with proportionately lower inputs. All optical measurements are preferably taken after the system has reached a steady state. Alternatively, a varying pulse width can be utilized to drive the LEDs and steady state output performance can be extrapolated from there. Steps S113, S115, and S117 could be implemented with any appropriated Color Coordinate System as described below.

Temperature and/or other relevant environmental data are then measured in step S118 using a temperature measurement device 47. The environmental data is measured to indicate the environmental conditions which result in the measured outputs of the LEDs. For example, LED output will vary based on temperature, so it is relevant to know for the measured optical outputs of the Red, Green, and Blue LEDs in steps S113, S115, and S117 what the temperature is at the time of measurement. The environmental measurement of step S118 is then used in a compensation algorithm 24 to control driving of the LEDs, as discussed below with reference to FIG. 6. The algorithm accommodates the optical output change resulting from intensity changes and dominant wavelength changes with temperature. Future changes away from the baseline environment can be corrected by the below discussed compensation algorithm 24.

All of the measured information is then stored internal to the LED assembly 100 in step S119. The stored information is represented by the following variables described below, using CIE values (x, y, Y), $V_f$ for forward voltage, and T for temperature.

$$(x_r, y_r, Y_r')V_{fr}, (x_g, y_g, Y_g')V_{fg}, (x_b, y_b, Y_b')V_{fb}, T$$

All of the stored information can be written in step S119 as described or alternatively the stored information could be written to a memory device of the LED assembly immediately after they are acquired in steps S113, S115, and S117. This alternative is shown by the dashed lines in FIG. 4.

Additional information about the performance of the unique light engine "as manufactured" can be stored internal to the system in step S119, e.g., possibly the date and time of the measurements or the serial number of the product. Storage of these initial measurements external to the system can also be performed. Duplicate data external to the LED assembly could be used in the repair or rework of an assembly or utilized for statistical analysis of the production variability. The process completes in step S120 by unloading the LED assembly 100 from the test system 100 and proceeding with usage of the LED light engine assembly 100.

Figure 6A:
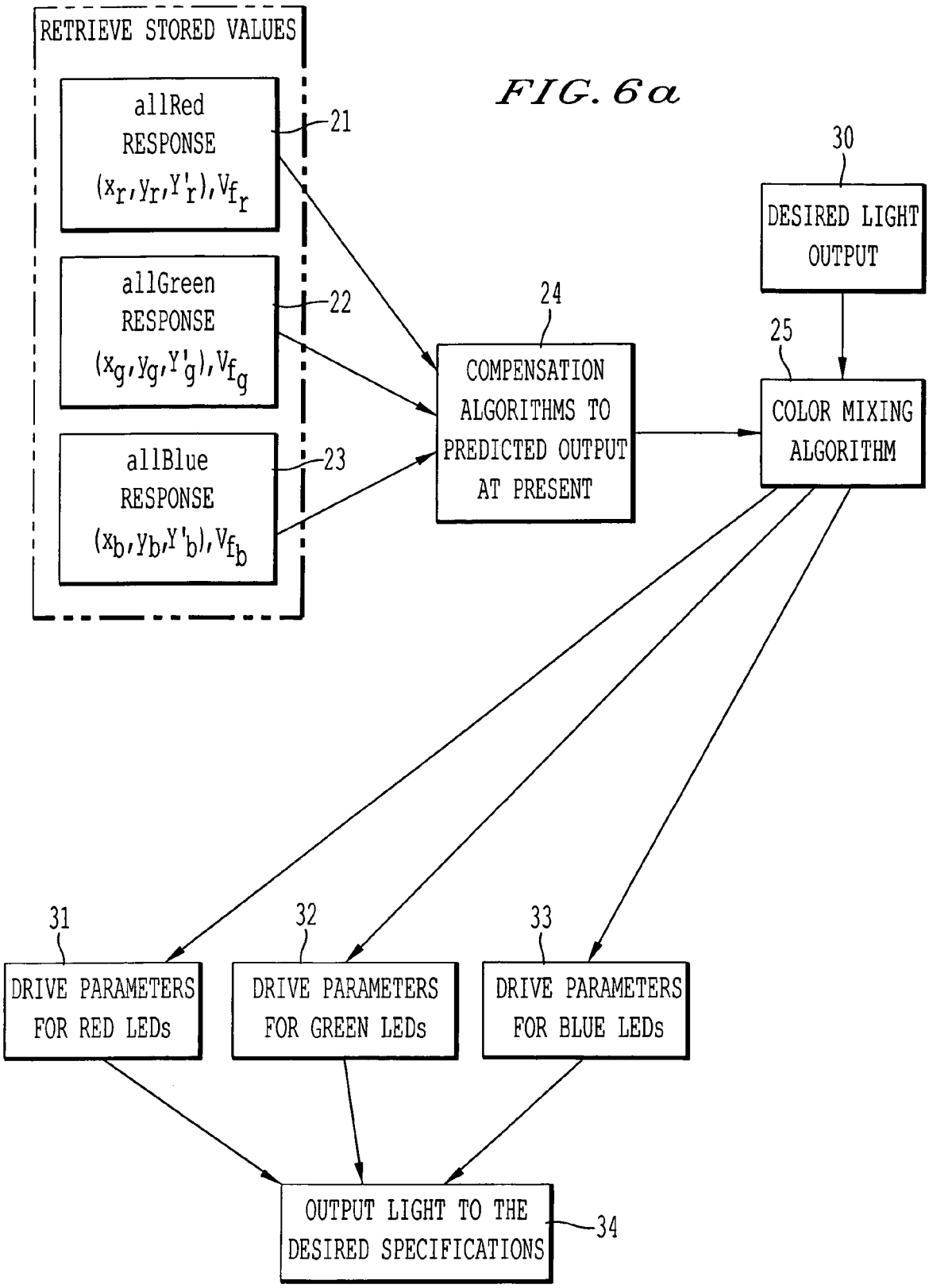
FIGS. 6*a*, 6*b* show an overview of processes for realizing a compensated optical output for an LED assembly of the present invention.
Figure 6B:
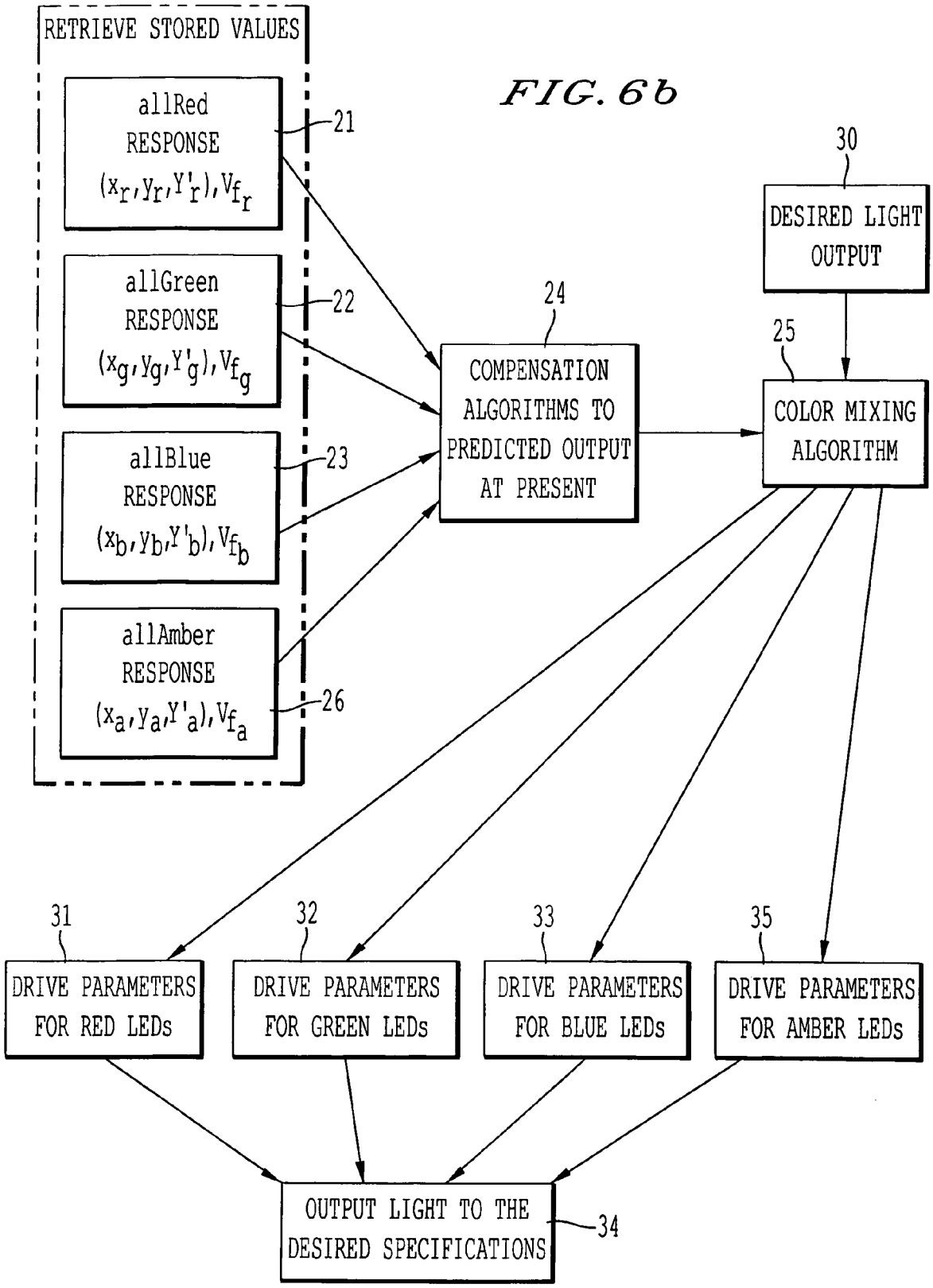
Figure 7:
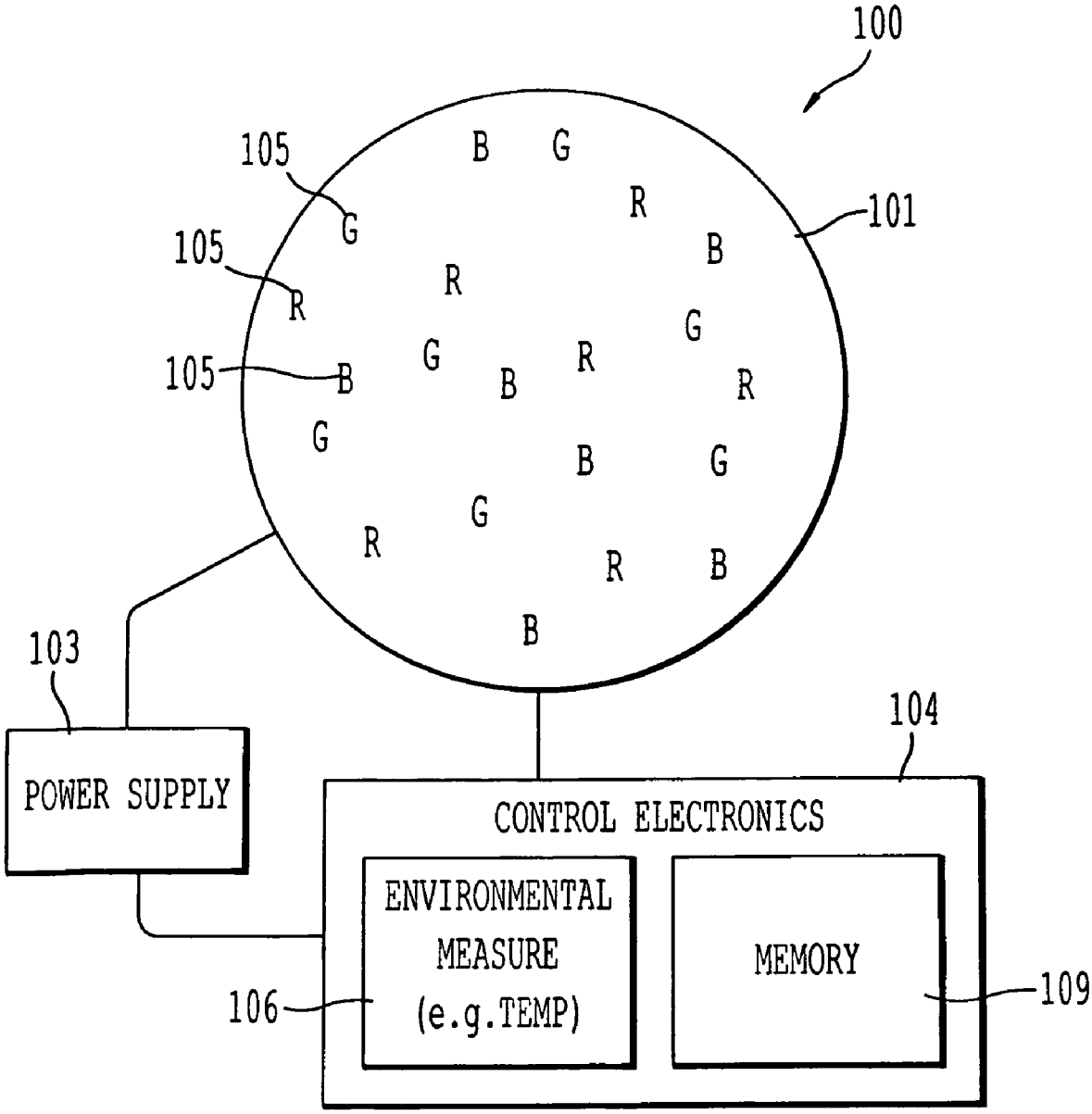
FIG. 7 shows an LED light engine assembly of a first embodiment of the present invention.

With the above process, the present invention characterizes and records the LED assembly's specific light output information at the time of manufacture to record baseline color output of the LED assembly, which information is then used in an overall process of generating compensated light output in an LED assembly in FIGS. 6 and 7. By so doing, an exact baseline of the displayed color can be made available to algorithms for color optimization.

FIGS. 6*a* and 6*b* and 7 show an LED assembly of the present invention which stores the data generated by the process in FIG. 4, and which utilizes such data to generate an enhanced desired light output of the proper color. FIG. 7 shows a structure of an LED assembly 100 including LEDs 105 in LED light 101 and power supply 103, in the present invention, and FIGS. 6*a* and 6*b* show control operations performed in that LED assembly 100.

As shown in FIG. 7, the LED assembly 100 of the present invention is similar to that in the background art of FIG. 1, except the LED assembly 100 of the present invention includes enhanced control electronics 104 including an environmental sensor 106 and memory 109. The memory 109 stores the data noted in step S119 in FIG. 4.

There are many ways that the information can be stored in the system, but one feature is that the "as manufactured" output information remains available to the optimization algorithms throughout the life of the light engine. The internal method of storing the information can be any of a number of memory devices. A Read Only Memory (ROM), a Programmable Read Only Memory (PROM), an Erasable Programmable Read Only Memory (EPROM), an EEPROM (an Electrically Erasable Programmable Read Only Memory), a Flash EPROMs, etc. can be used, as the memory 109.

The control electronics 104 in FIG. 7 performs the operation shown in FIGS. 6*a*, 6*b*, as now discussed in further detail below.

A first embodiment of the overall control operation of the LED assembly 100 of the present invention as shown in FIG. 6*a* is to utilize the stored baseline light output data of the Red LEDs, Green LEDs, and Blue LEDs that form the LED light 101 in conjunction with the stored environmental data, perform compensations based on the measured output of those lights and based on measured environmental values, and to output a desired light output.

In the operation, stored values for the allRed response, allGreen response, and allBlue response are retrieved in processes 21-23. Those values correspond to the values stored in step S119 in FIG. 4. That retrieved information in processes 21-23 can be utilized by compensation and color mixing algorithms to allow a custom color generation to be realized.

More specifically, the retrieved stored values from processes 21-23 are provided to a process 24 that runs a compensation algorithm to predict an output under current environmental conditions based on the retrieved stored values. An output from that compensation algorithm 24 is then provided to a color mixing algorithm 25. The color mixing algorithm 25 receives as an input a desired light output from a process 30. Thereby, the color mixing algorithm 25 receives an indication as to a desired light output and can modify the color mixing to achieve that desired light output. The color mixing algorithm 25 then controls driving of parameters for the Red LEDs, Green LEDs, and Blue LEDs in processes 31-33 to output light of a desired specification in process 34.

The compensation algorithm 24 and color mixing algorithm 25 are the control algorithms to achieve a desired color output and are either hard programmed with electronic circuitry or soft programmed with custom software internal to the control electronics 104 of the LED light engine assembly 100. The color mixing algorithm 25 adjusts the duty cycle (D) and other parameters of each LED in processes 31-33, effectively modifying the percentages of each base color to customize the color display. The duty cycle can be adjusted using any number of control techniques—including Pulse Frequency Modulation, Pulse Position Modulation, Amplitude Modulation, Phase Shift Modulation, and Pulse Width Modulation (see e.g., U.S. Pat. No. 6,016,038 to Color Kinetics).

Operating the compensation algorithm 24 and color mixing algorithm 25 in combination with retrieving the stored optical parameters in processes 21, 22, and 23 resolves many of the performance issues of LED light engine assemblies. The compensation algorithm 24 can be applied to account for temperature variations in the optical output. Similarly, the lifetime degradation of LEDs can be overcome algorithmically in the compensation algorithm 24. That is, the compensation algorithm 24 can consider current environmental conditions, aging of the LED, etc., and can compensate the light output of the LEDs for such current conditions. For example light output of LEDs drops with temperature. Therefore, if the current temperature at the LED assembly 100 is higher than when the LEDs were tested, i.e., higher than the temperature stored in step S119 in FIG. 4, then the compensation algorithm 24 can control to increase the driving power of each of the LEDs to compensate for the decreased intensity resulting from the increased temperature. Similarly, the compensation algorithm 24 can factor the age of the LEDs and increase the driving current (I) to the LEDs 105 as the LEDs 105 age. The compensation algorithm 24 can perform other compensations based on other environmental conditions, for example humidity, and other factors as needed.

Further, difficulties of recipes and binning can be accommodated by appropriate application of the color mixing algorithm 25. The compensation algorithm 24 and color mixing algorithm 25 can provide for calculations of the compensated light rendering process because of an accurate known starting point. That is accomplished in the process of the present invention.

A specific non-limiting example of specifics of color mixing algorithm 25 that can be implemented in the present invention is as follows.

The color mixing algorithm 25 begins with the target color specified for display.

$$\text{Targeted Color Coordinates } (x_t, y_t, Y_t') \tag{151}$$

The CIE Chromaticity coordinates (x, y, Y') of the spectral input for allRed, allGreen, and allBlue are also known to the algorithm, see steps S113, S115, S117 in FIG. 4.

$$\text{Measured } (x_r, y_r, Y_r'), (x_g, y_g, Y_g'), (x_b, y_b, Y_b') \tag{152}$$

The desired output is the duty cycle of the allRed, allGreen, and allBlue LED assemblies for display of the target color and the driving current.

$$\text{Find } (D_{r_t}', D_{g_t}', D_{b_t}') \text{ and I} \tag{153}$$

The derivation and details for a non-limiting implementation of the color mixing algorithm 25 is as follows.

First, z need not be given for any of the colors because of the following defining equation.

$$x+y+z=1$$

$$z=1-x-y \tag{154}$$

Linear proportionality constants (weighting factors) for the relationship between the output intensity and y coordinate for allRed, allGreen, and allBlue are calculated.

$$m_r=(Y_r'/y_r)$$

$$m_g=(Y_g'/y_g)$$

$$m_b=(Y_b'/y_b) \tag{155}$$

The proportionality constants are used to calculate the CIE coordinates of the combination of allRed, allGreen, and allBlue—ideally a true white color.

$$x_w = \frac{x_r m_r + x_g m_g + x_b m_b}{m_r + m_g + m_b} \tag{156}$$

$$y_w = \frac{y_r m_r + y_g m_g + y_b m_b}{m_r + m_g + m_b}$$

$$Y_w' = Y_r' + Y_g' + Y_b'$$

CIE coordinates are converted to Tristimulus values. Tristimulus values are a similar coordinate system for describing the color that is not normalized. The relationship between the 2 coordinate systems is defined by the following equations (157).

$$Y=Y' \; x=X/(X+Y+Z) \; y=Y/(X+Y+Z) \; z=Z/(X+Y+Z) \tag{157}$$

The following general equations can be quickly derived from equations (154) and (157) above.

$$\frac{X}{Y} = \frac{x}{y} \quad \frac{Z}{Y} = \frac{z}{y} \quad \frac{Z}{Y} = \frac{(1-x-y)}{y} \tag{158}$$

The general equations (158) above create the specific equations for the Tristimulus values X, Y, Z for allGreen, allRed, allBlue and the resultant white shown as equations (159). It is important to note that this white may not necessarily appear white. The degree to which it is truly white will depend on how evenly balanced the 3 stimulus colors are around the center coordinates of white (0.333, 0.333, 0.333).

$$X_r = \frac{x_r Y'_r}{y_r} \quad Y_r = Y'_r \quad Z_r = \frac{(1 - x_r - y_r)Y'_r}{y_r} \tag{159}$$

$$X_g = \frac{x_g Y'_g}{y_g} \quad Y_g = Y'_g \quad Z_g = \frac{(1 - x_g - y_g)Y'_g}{y_g}$$

$$X_b = \frac{x_b Y'_b}{y_b} \quad Y_b = Y'_b \quad Z_b = \frac{(1 - x_b - y_b)Y'_b}{y_b}$$

$$X_w = \frac{x_w Y'_w}{y_w} \quad Y_w = Y'_w \quad Z_w = \frac{(1 - x_w - y_w)Y'_w}{y_w}$$

The same equations can be used to convert the given CIE values of the target color to $(x_t, y_t, Y_t')$ to Tristimulus values of $(X_t, Y_t, Z_t)$ as below.

$$X_t = \frac{x_t Y'_t}{y_t} \quad Y_t = Y'_t \quad Z_t = \frac{(1 - x_t - y_t)Y'_t}{y_t} \tag{160}$$

Scale Factors $(S_r, S_g, S_b)$ are required for the transformation matrix M and are calculated from the known values on the right hand side of equation (160) as follows.

$$[S_r \quad S_g \quad S_b] = [X_w \quad Y_w \quad Z_w] \begin{bmatrix} X_r & Y_r & Z_r \\ X_g & Y_g & Z_g \\ X_b & Y_b & Z_b \end{bmatrix}^{-1} \tag{161}$$

$$[M] = \begin{bmatrix} S_r X_r & S_r Y_r & S_r Z_r \\ S_g X_g & S_g Y_g & S_g Z_g \\ S_b X_b & S_b Y_b & S_b Y_b \end{bmatrix} \tag{162}$$

The $[R_t\ G_t\ B_t]$ for the target color is the amount of Red, Green, and Blue in the target color and could be used to describe the color if an RGB specification system were utilized as follows.

$$[R_t G_t B_t] = [X_t Y_t Z_t][M]^{-1} \tag{163}$$

The duty cycle, D, of each of the colors is calculated below. For ease of implementation, one of the three duty cycles for allRed, allBlue, or allGreen is always defined as 100%. The other two duty cycles are scaled to keep similar RGB proportions.

$$D_{r_{t=R'}}/\max(R_t, G_t, B_t) D_{g_{t=G'}}/\max(R_t, G_t, B_t) D_{b_{t=B'}}/\max(R_t, G_t, B_t) \tag{164}$$

Further simplifying for the instance when $[S_r, S_g, S_b]=[1.0, 1.0, 1.0]$, the instance is relevant when the design requirements state that the combination of allRed, allGreen, and allBlue does not have to be a pure white.

$$c = x_b(y_g - y_r) + x_g(y_r - y_b) + x_r(y_b - y_g)$$

$$R_t = -\frac{y_r[x_b(y_t - y_g) + x_t(y_g - y_b) + x_g(y_b - y_t)]}{y_t \cdot Y'_r \cdot c}$$

-continued $$G_t = \frac{y_g[x_b(y_t - y_r) + x_t(y_r - y_b) + x_r(y_b - y_t)]}{y_t \cdot Y'_g \cdot c}$$

$$B_t = \frac{y_b[x_t(y_g - y_r) + x_g(y_r - y_t) + x_r(y_t - y_g)]}{y_t \cdot Y'_b \cdot c}$$

$$D_{r_t} = R_t/\max(R_t, G_t, B_t)$$

$$D_{g_t} = G_t/\max(R_t, G_t, B_t)$$

$$D_{b_t} = B_t/\max(R_t, G_t, B_t)$$

The present equations have only related to the generation of the color and not to the intensity of the color. The target color intensity is expressed by $Y_t'$. Adjustments for intensity are calculated as follows:

$$Y_{total}' = Y_r' + Y_g' + Y_b'$$

$I_{ref}$ is the driving current specified by the LED manufacturer and used in the manufacturing testing process to generate the stored values for processes 21, 22, and 23 of FIG. 6.

Case 1: If $Y_{total}' \geqq Y_t'$ then the following equations apply. The duty cycles are downscaled appropriately to account for the intensity.

$$D'_{r_t} = \frac{Y'_t}{Y'_{total}} D_{r_t}$$

$$D'_{g_t} = \frac{Y'_t}{Y'_{total}} D_{g_t}$$

$$D'_{b_t} = \frac{Y'_t}{Y'_{total}} D_{b_t}$$

$$I = I_{tested}$$

Case 2: If $Y_{total}' < Y_t'$ then the following equations apply. The driving current is upscaled appropriately to accommodate the additional required brightness.

$$D'_{r_t} = D_{r_t}$$

$$D'_{g_t} = D_{g_t}$$

$$D'_{b_t} = D_{b_t}$$

$$I = \frac{Y'_t}{Y'_{total}} I_{tested}$$

The targeted color is therefore displayed for both case 1 and case 2 using the duty cycles $(D_{r_t}', D_{g_t}', D_{b_t}')$ and the driving current I.

FIG. 6*b* shows a modification of the embodiment of FIG. 6*a*, which can be applied to a device including different colored LEDs of Red LEDs, Blue LEDs, Green LEDs, and Amber LEDs. That is, instead of having a system with only three colors of Red, Blue, and Green, a system can incorporate four colors of Red, Blue, Green, and Amber. In those circumstances the operations shown in FIGS. 3*a*, 3*b*, and 4 will also perform operations directed to the Amber LEDs similarly as for the Red, Green, and Blue LEDs. As a result, measured optical values stored in memory will also include data for the Amber LEDs, and thus in FIG. 6*b* an additional operation of retrieving the all Amber response in process 26 is executed, and then in process 34 the duty cycle and other parameters of the Amber LEDs are also adjusted similarly as for the Red, Green, and Blue LEDs.

The present invention is not even limited to such an embodiment with four colors, but any number and colors can be used in any desired combination.

A previous example assembly is now used for the discussion on the present invention. Assume a previous assembly includes several Red LEDS, several Green LEDs, and several Blue LEDs. Additionally, for ease of explanation the combined output from all Red LEDs shall be referred to as the allRed Output. If there is only one Red LED then the output of the Red LED and allRed will be equal. Similarly, the display of all Green LEDs shall be referred to as allGreen and all Blue LEDs as allBlue.

The process of the present invention allows the generation of an exact, known, starting point or baseline of the color output and internal storage of that known starting point within the system. The light output of a specific LED assembly is initially stored internal to the assembly on an appropriate memory device. This initial point can be utilized by an appropriate compensation algorithm 24 and an appropriate color mixing algorithm 25 at any later point in time to produce a desired color match.

The process of the present invention involves storing the specific light output description internal to the LED light engine assembly, by the process of FIG. 4, which is then used for custom color rendering. Then, in operation of the LED assembly 100 the stored data are retrieved in processes 21, 22, and 23 of the compensated light process of FIG. 6. By so doing, an exact baseline of the displayed color can be made available to the compensation algorithm 24 and color mixing algorithm 25. The processes S113, S115 and S117 of FIG. 4 generate the CIE coordinates of allRed, allGreen and allBlue, and the processes 21, 22 and 23 of FIG. 6 utilize the CIE coordinates of allRed, allGreen and allBlue.

The allocated memory 109 for storing the initial optical performance information can be a dedicated single component. Alternatively, the information can be combined with other system information and added to the storage components that already reside in the system. For instance, the stored output of the manufacturing process of the present invention could be added to the firmware of the control system and stored on the same physical device as the firmware.

Color specifications in the process of FIG. 4 can be transmitted using the CIE Color Coordinate System. There are other universal color coordinate systems that are device independent that could also be utilized to quantify the light source. The Lab Model uses Lightness (L), an (a) coordinate along a green to red spectrum, and (b) coordinate along a blue to yellow spectrum. The Munsell Color System uses three coordinates of Hue (H), Value (V), and Chroma (C). The present invention does not exclude the usage of any of these universal color coordinate systems, but that the CIE System is believed to be the most effective at communicating an exact color.

If another coordinate system is used then the measured and stored values would not be exactly the variables listed below $$(x_r,y_r,Y_r')V_{f_r},(x_g,y_g,Y_g')V_{f_g},(x_b,y_b,Y_b')V_{b_b},T$$

Conceptually, they would be similar values describing the color but in a new coordinate system. For instance for an Lab Model they would most likely be $$(L_r,a_r,b_r)V_{f_r},(L_g,a_g,b_b)V_{f_g},(L_b,a_b,b_b)V_{b_b},T$$

And for the Munsell System they might be $$(H_r,V_r,C_r)V_{f_r},(H_g,V_g,C_g)V_{f_g},(H_b,V_b,C_b)V_{b_b},T$$

There are a number of different Color Coordinate System standards based around the 3 colors of Red, Green, and Blue. Examples of standard RGB color spaces include ISO RGB, sRGB, ROMM RGB, Adobe RGB, Apple RGB, and video RBG spaces (NTSC, EBU, ITU-R BT.709). But none of these standards are universal, and there may never be a universal RGB standard because the needs of different applications (scanners, digital cameras, monitors, printers) are different. There are also CMYK color standards based on proportions of Cyan, Magenta, Yellow, and Black. The CMYK standards suffer from the same lack of universality disadvantage as the RGB standards. Any of these standards could be used for the color description of the present invention, but the CIE Color Coordinate System may be the preferred implementation because of its more universal acceptance.

The process described above with respect to FIG. 4 shows obtaining data for a system with up to three colors, and FIG. 6*b* shows application for a system with up to four colors. There is no requirement that the system include only these colors but any number of colors can be incorporated. A more generalized process that can be performed in the present invention is shown in FIG. 8, which essentially achieves the same results as the process of FIG. 4, but which can be applied to as many colors as desired with different environmental conditions.

Figure 8:
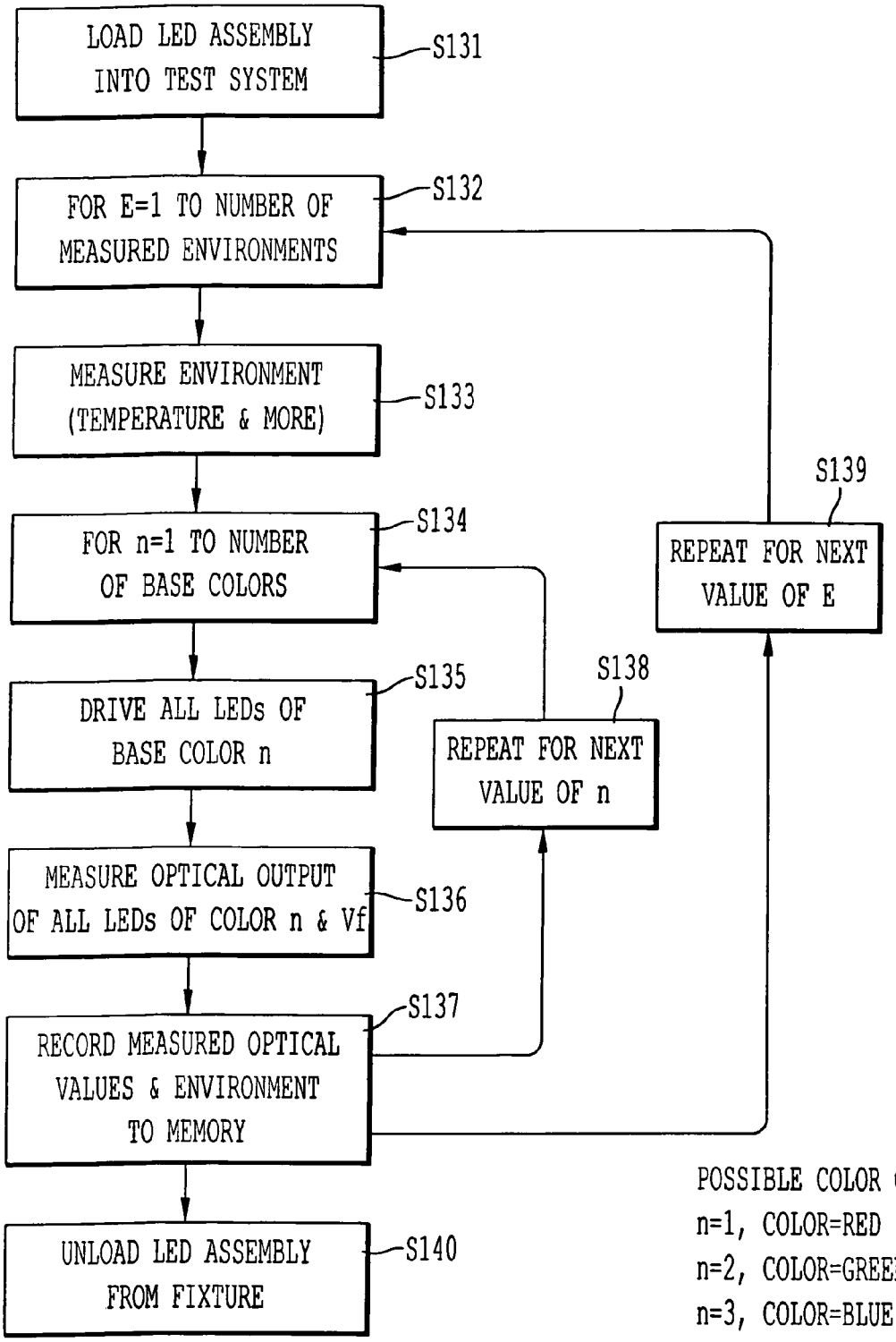
FIG. 8 shows a more generalized operation of processes performed in manufacturing an LED assembly according to the present invention.

The more generalized process of FIG. 8 has the same goal as the process of FIG. 4. Step S131 begins the generalized process by loading the LED light engine assembly 100 into the test system 40. Step S132 is the beginning of an "outer loop" iteration function designed to quantify the relevant, baseline optical properties across a number of environments. If only one environment is baselined as in the specific example above, then the number of environments is one and the iteration loop is only performed once. The environments can either be controlled, as in a thermal and humidity test chamber, or uncontrolled, as the LED die temperature at the time of manufacture. Relevant environmental variations might be temperature, humidity, system "on time", altitude, or any other environmental condition. Step S133 quantifies the relevant environmental condition either using an environmental sensor, e.g. temperature sensor 47. Step S134 begins another "inner loop" iteration function for each base color. In the specific examples, the number of base colors is three or four (Red, Green, Blue, and optionally Amber) and the iteration loop is performed three or four times.

Step S135 drives all of the LEDs of a single base color. In general the LEDs are all driven with 100% input current and measured. Other values of inputs could be used with linear, logarithmic, or other appropriate scaling applied in the subsequently executed algorithms. In step S136 the light output and forward voltage is measured and quantified for the combination of base color and environmental condition being tested. Step S137 records the measured values of step S136 to memory 109. The storage to memory in step S137 could occur after each measurement is taken or collectively after all measurements have been taken. The "inner loop" iteration function of step S138 repeats the process for each base color. The "outer loop" iteration function of step S139 repeats the process for each environmental condition. Each environmental condition for example could be temperature of an ambient temperature value, a hot temperature value, and a cold temperature value. The "inner loop" and "outer loop" functions can be swapped as long as all of the base colors and environments are quantified. Step S140 concludes the process by removing the LED light engine assembly 100 from the test system 40. At the conclusion of step S130 the internal memory 109 now includes baseline optical performance of the specific LED light engine assembly.

By including the baseline optical performance of the unique LED light engine assembly internal to the control electronics, improvements can be made in the manufacturing, the functioning, and the quality of light output of an LED assembly. Referring to FIG. 7, each LED light engine assembly has in memory 109 the starting point of the optical output of its installed LEDs 105 under known environmental conditions. Without the stored values generated by the processes 21, 22, 23, 26 of the present invention, an assumed value, like the average optical output of a set of LEDs, would be required for the starting point of the compensation algorithm 24 and the color mixing algorithm 25. The result of using the generated set of stored values is a considerably improved process for the following reasons: an infinite number of targeted output colors can be rendered by utilizing the known starting point of the unique LED assembly and applying color mixing algorithms; accuracy of the rendered color is improved because the color mixing algorithms begin with the known starting point of optical color performance; repeatability of the target color is improved because compensation for intensity degradation over a product lifetime can be applied from the known starting point; color rendering is more repeatable because compensation to account for wavelength variations and intensity variations with temperature can be applied from the known starting point; recipes and binning can be reduced or eliminated because the LED light engine assembly can perform algorithms to compensate for the manufacturing variations of the individual LEDs.

The end result is an LED light engine assembly capable of rendering more colors accurately and repeatably while improving costs and manufacturability.

Obviously, numerous additional modifications and variations of the present invention are possible in light of the above teachings. It is therefore to be understood that within the scope of the appended claims, the present invention may be practiced otherwise than as specifically described herein.

The invention claimed is:

1. A process for manufacturing a light emitting diode (LED) assembly including LEDs of a plurality of colors comprising, performed during manufacturing the LED assembly, (a) driving all LEDs of a first color and measuring information of an optical output of the driven LEDs;

(b) measuring a first environmental condition while the driving all the LEDs;

(c) storing in a memory in the LED assembly the measured first environmental condition and the measured information of optical output; and (d) repeating the driving (a) and measuring (b) and storing (c) for the LEDs of each of the plurality of colors.

2. The process according to claim 1, wherein the LED assembly includes red LEDs, blue LEDs, and green LEDs.

3. The process according to claim 1, wherein the LED assembly includes red LEDs, blue LEDs, green LEDs, and amber LEDs.

4. The process according to claim 1, wherein the first environmental condition is temperature.

5. The process according to claim 1, further comprising:

(e) repeating each of (a) to (d) for a second environmental condition.

6. The process according to claim 5, wherein the LED assembly includes red LEDs, blue LEDs, and green LEDs.

7. The process according to claim 1, wherein the measured optical output includes CIE color information and forward voltage of the LEDs of each color.

* * * * *